US008479474B2

(12) United States Patent
Chestnut, Jr.

(10) Patent No.: US 8,479,474 B2
(45) Date of Patent: Jul. 9, 2013

(54) SHINGLE INSTALLATION DEVICE

(76) Inventor: John P. Chestnut, Jr., Rayland, OH (US)

( * ) Notice: Subject to any disclaimer, the term of this patent is extended or adjusted under 35 U.S.C. 154(b) by 602 days.

(21) Appl. No.: 12/154,740

(22) Filed: May 27, 2008

(65) Prior Publication Data

US 2008/0289291 A1 Nov. 27, 2008

Related U.S. Application Data

(60) Provisional application No. 60/924,699, filed on May 25, 2007.

(51) Int. Cl.
*E04D 15/02* (2006.01)

(52) U.S. Cl.
USPC ... 52/749.12; 52/749.1; 52/748.1; 52/DIG. 1; 81/45; 33/646; 33/648

(58) Field of Classification Search
USPC ..... 52/749.1, 749.12, 748.1, DIG. 1; 81/45; 33/646, 648
See application file for complete search history.

(56) References Cited

U.S. PATENT DOCUMENTS

| | | | | |
|---|---|---|---|---|
| 54,584 | A | 5/1866 | Newbank | |
| 285,137 | A * | 9/1883 | Kennedy | 33/647 |
| 338,156 | A | 3/1886 | Johnson | |
| 377,085 | A | 1/1888 | Russell | |
| 377,178 | A | 1/1888 | Traut | |
| 378,548 | A | 2/1888 | Hotchkiss | |
| 418,754 | A * | 1/1890 | Schill | 33/646 |
| 476,257 | A | 6/1892 | Finmand | |
| 496,483 | A * | 5/1893 | Miller | 248/237 |
| 563,830 | A | 7/1896 | Pelley | |
| 631,315 | A * | 8/1899 | Meskill | 33/647 |
| 780,697 | A | 1/1905 | Adams | |
| 786,710 | A | 4/1905 | Anderson | |
| 832,962 | A | 10/1906 | Fellows | |
| 844,612 | A | 2/1907 | Morris | |
| 995,574 | A * | 6/1911 | Sarlls | 33/646 |
| 1,067,121 | A | 7/1913 | Johnson | |
| 1,115,202 | A * | 10/1914 | Ingles | 33/646 |
| 1,210,469 | A | 1/1917 | Harshberger | |
| 1,256,192 | A | 2/1918 | Aksdal | |
| 1,366,462 | A | 1/1921 | Johnson | |
| 1,380,485 | A | 6/1921 | Langeberg | |
| 1,396,274 | A | 11/1921 | Neumeister | |
| 1,405,760 | A | 2/1922 | Collins et al. | |
| 1,556,649 | A | 10/1925 | Topping | |
| 1,582,620 | A | 4/1926 | Ostrander | |
| 1,586,946 | A | 6/1926 | Carr | |
| 1,598,986 | A | 9/1926 | Ping | |
| 1,750,854 | A | 3/1930 | Nelson | |

(Continued)

*Primary Examiner* — Robert Canfield
*Assistant Examiner* — Matthew Gitlin
(74) *Attorney, Agent, or Firm* — Renner, Kenner, Greive, Bobak, Taylor & Weber

(57) ABSTRACT

A shingle installation device comprises a body that maintains an alignment stop and a positioning stop that are parallely spaced by a predetermined distance to provide suitable overlap of successively installed shingles. The body also maintains a retainer that forms a gap that is configured to receive and retain the position of a shingle that is being installed. Thus, when the installation device is positioned such that the alignment stop rests against an edge of an installed shingle, an edge of the shingle to be installed is placed within the gap where it is retained in its correct position until the shingle is fastened to the surface being covered.

11 Claims, 5 Drawing Sheets

U.S. PATENT DOCUMENTS

| | | | | | |
|---|---|---|---|---|---|
| 2,157,663 | A | * | 5/1939 | Giebink | 33/649 |
| 2,243,468 | A | | 5/1941 | Johnson | |
| 2,470,183 | A | | 5/1949 | Peters | |
| 2,794,261 | A | | 6/1957 | Fudge | |
| 2,887,781 | A | * | 5/1959 | Mills | 33/648 |
| 2,889,632 | A | | 6/1959 | Longhi | |
| 2,891,318 | A | | 6/1959 | Harrison et al. | |
| 3,110,113 | A | | 11/1963 | Baker | |
| 3,257,671 | A | | 6/1966 | Crookston | |
| 3,490,152 | A | * | 1/1970 | Printz | 33/649 |
| 3,792,852 | A | | 2/1974 | Reniker | |
| 4,056,889 | A | | 11/1977 | Barnett, III | |
| 4,110,911 | A | | 9/1978 | Sucheck | |
| 4,183,144 | A | | 1/1980 | Barnett, III | |
| 4,285,134 | A | | 8/1981 | Schmanski | |
| 4,425,714 | A | * | 1/1984 | Kelly, Jr. | 33/646 |
| 4,785,606 | A | | 11/1988 | Burton | |
| 4,860,518 | A | | 8/1989 | Kingham | |
| 4,862,669 | A | * | 9/1989 | Jacobsen | 52/749.1 |
| 5,018,279 | A | | 5/1991 | Williams | |
| 5,081,815 | A | | 1/1992 | Carnell | |
| 5,197,257 | A | | 3/1993 | Nietling | |
| 5,205,103 | A | | 4/1993 | Burton | |
| D335,461 | S | * | 5/1993 | Horsley, Jr. | D10/64 |
| D338,635 | S | * | 8/1993 | Spindler et al. | D10/64 |
| D338,814 | S | * | 8/1993 | Wright et al. | D8/14 |
| 5,319,909 | A | * | 6/1994 | Singleterry | 52/749.1 |
| 5,335,423 | A | * | 8/1994 | McLaughlin | 33/647 |
| 5,400,519 | A | * | 3/1995 | Meyer | 33/646 |
| D362,812 | S | * | 10/1995 | Meyer | D10/64 |
| 5,465,499 | A | * | 11/1995 | LaPlante | 33/647 |
| 5,522,149 | A | * | 6/1996 | Meyer | 33/646 |
| 5,526,577 | A | | 6/1996 | Nix | |
| 5,575,132 | A | | 11/1996 | Garsjo | |
| 5,642,596 | A | | 7/1997 | Waddington | |
| D411,469 | S | * | 6/1999 | Smith | D10/65 |
| 5,918,439 | A | | 7/1999 | Metzer | |
| 6,378,223 | B1 | | 4/2002 | Korich | |
| 6,401,425 | B1 | | 6/2002 | Frame | |
| 6,470,642 | B1 | | 10/2002 | Eads | |
| 6,705,021 | B2 | * | 3/2004 | Nadal et al. | 33/647 |
| 6,880,741 | B2 | | 4/2005 | Gill | |
| 7,134,253 | B2 | * | 11/2006 | Edwards et al. | 52/749.11 |
| 7,543,422 | B2 | * | 6/2009 | Tomczak | 52/749.11 |
| 2004/0010929 | A1 | | 1/2004 | Whitford | |
| 2004/0237461 | A1 | * | 12/2004 | Edwards et al. | 52/749.1 |

* cited by examiner

SHINGLE INSTALLATION DEVICE

CROSS-REFERENCE TO RELATED APPLICATION

This application claims the benefit of U.S. Provisional Application No. 60/924,699, filed May 25, 2007. The specification of the above-referenced application is incorporated herein by reference.

TECHNICAL FIELD

The present invention generally relates to a device to facilitate the installation of shingles. Particularly, the present invention relates to a device that enables accelerated alignment and positioning of shingles during their installation.

BACKGROUND ART

In the past, shingles, such as those typically installed upon the roof of a house, or other structure, have been applied using various techniques. For example, one technique of installing shingles involves gauging the position of each row of shingles by the top of the slots in the row of shingles below. However, this technique can be inaccurate if the slots maintained by any of the shingles are uneven. Furthermore, this process can be very inefficient and inaccurate, as each shingle is required to be positioned and lined-up with the slot by hand by visually estimating where the shingle should be placed. Another method of installing roof shingles involves using chalk lines that are struck or otherwise applied upon the roofing paper sub-surface so as to provide a reference or guide for the top edge of a newly-installed shingle so as to ensure it is installed with the correct spacing. While this method is preferred by many shingle installers, such method is subject to yielding inaccurate results, as the shingles themselves, due to manufacturing variation, can vary in width, thus resulting in shingles that are misaligned. This method can also be time consuming, as the position of each shingle is required to be adjusted by hand so that the shingle is aligned with the chalk line. Yet another method of installing shingles utilizes an alignment gauge that is provided on the underside of an air nail gun to aid in positioning the shingles at their appropriate location. This method can also yield misaligned shingles, as the other protrusions or dimensions of the nail gun can cause the shingles to get caught as the shingles are installed, causing the spacing between adjacent shingles to be thrown off. In addition, the installer must continuously check that the alignment gauge of the air gun remains in proper position to prevent the misalignment of shingles, which is tedious and time consuming.

Although various devices have been developed to overcome one or more of the aforementioned deficiencies associated with the accurate placement and installation of shingles, such devices tend to be difficult to use, and often create other obstacles that impede the user's ability to achieve the accurate and consistent alignment of shingles.

Therefore, there is a need in the art for a shingle installation device that is user-friendly, and easy to use while yielding accurate, consistent, and efficient alignment of shingles. In addition, there is a need for a shingle installation device that provides a positioning stop and an alignment stop that are spaced by a predetermined distance, such that when the alignment stop is positioned against the bottom edge of an installed shingle, the positioning stop is oriented at a suitable position for the installation of a successive, or subsequent shingle. Furthermore, there is a need for a shingle installation device that maintains a retainer to hold the edge of a shingle to be installed in position before it is fastened to a surface. Still yet, there is a need for a shingle installation device that maintains a shield to protect an installer's hand from injury during shingle installation. In addition, there is a need for a handle that is substantially aligned with the length orientation of the shingle installation device to allow the installation device to be more efficiently moved from position to position.

SUMMARY OF THE INVENTION

One aspect of the present invention provides a shingle installation device to facilitate the attachment of shingles to a surface comprising a body having a first surface opposite a second surface; a positioning stop maintained along an edge of said body to align an edge of a shingle to be installed; an alignment stop extending from said second surface configured to be positioned against an installed shingle, said positioning stop and said alignment stops parallely spaced at a predetermined distance from each other; and a retainer extending from said positioning stop, said retainer spaced from said second surface of said body to retain the edge of the shingle to be installed.

Another aspect of the present invention provides a method for installing a shingle to a surface, the method comprising, providing a shingle installation device comprising a body having a length orientation and a width orientation, said body having a parallely oriented positioning stop and alignment stop separated by a predetermined distance, said positioning stop maintaining a retainer extending therefrom to form a gap; providing a predetermined reference edge upon the structure; aligning said alignment stop against said reference edge; placing one edge of a shingle to be installed against said positioning stop and within said gap such that said shingle to be installed is offset from said reference edge by said predetermined distance; and attaching said shingle to be installed to the surface with at least one suitable fastener.

Yet another aspect of the present invention provides a shingle installation device to facilitate the attachment of shingles to a surface comprising a body having a first surface opposite a second surface; a positioning stop maintained along an edge of said body to align an edge of a shingle to be installed; an alignment stop extending from said second surface configured to be positioned against an installed shingle, said positioning stop and said alignment stops parallely spaced at a predetermined distance from each other; and a handle attached to said first surface, said handle having a grab surface substantially parallel with said positioning stop.

BRIEF DESCRIPTION OF THE DRAWINGS

For a complete understanding of the objects, techniques and structure of the invention, reference should be made to the following detailed description, appended claims, and accompanying drawings, wherein:

BEST MODE FOR CARRYING OUT THE INVENTION

Figure 1:
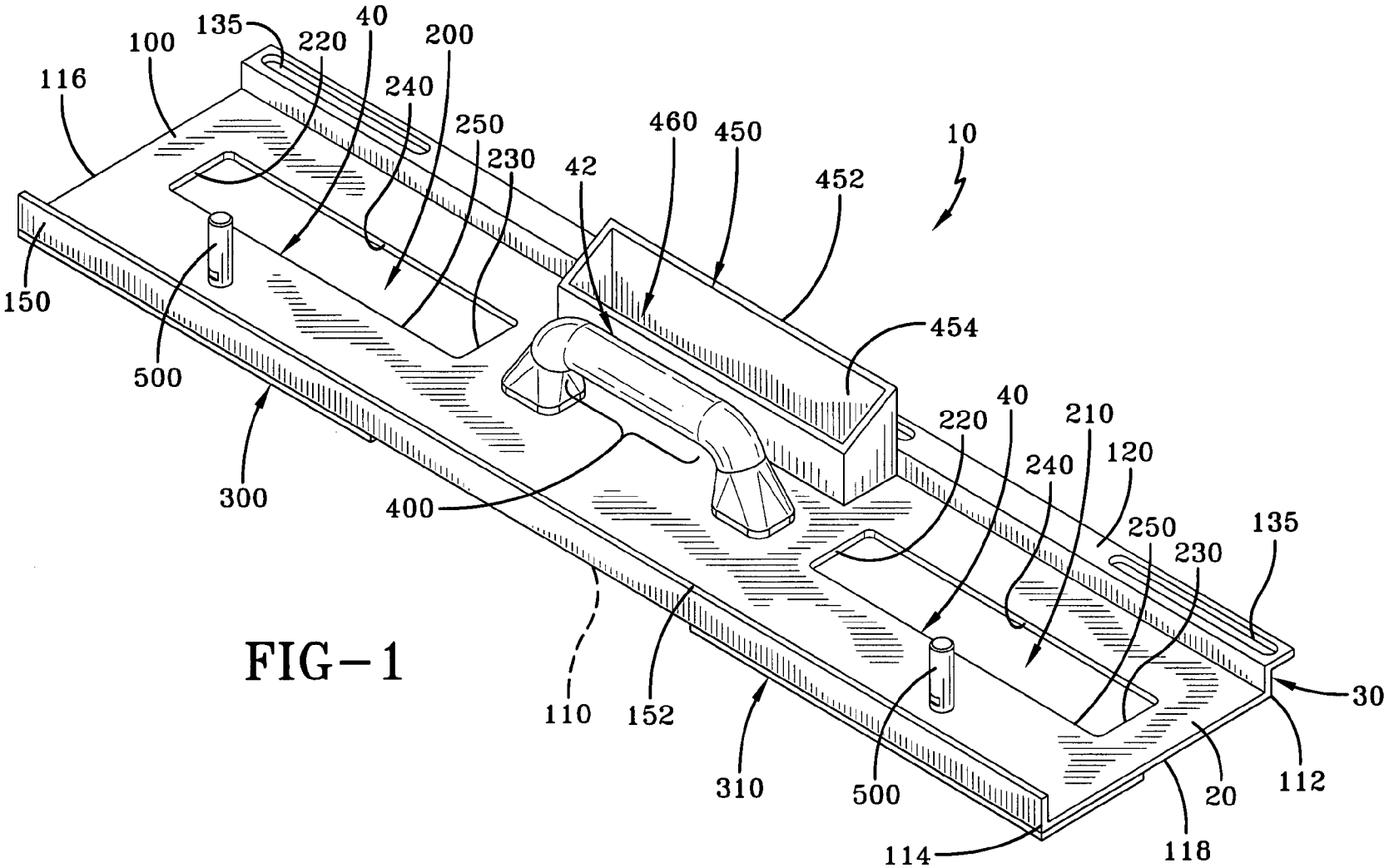
FIG. 1 is a top perspective view of a shingle installation device in accordance with the concepts of the present invention.
Figure 2:
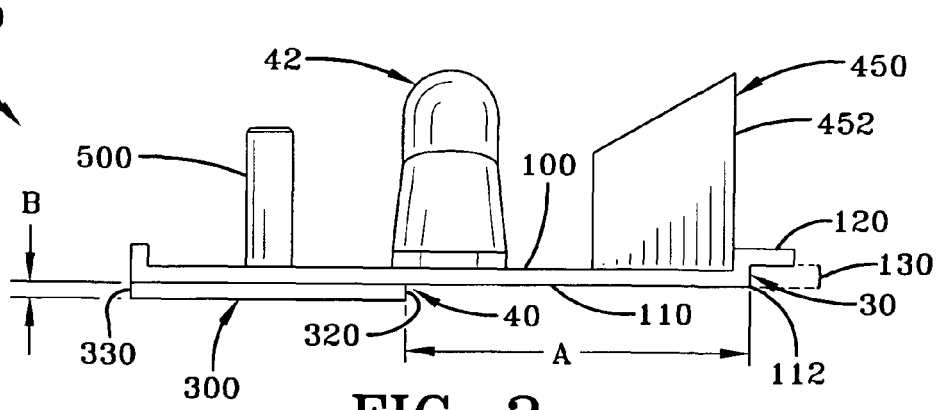
FIG. 2 is a side elevational view of the shingle installation device in accordance with the concepts of the present invention.
Figure 3:
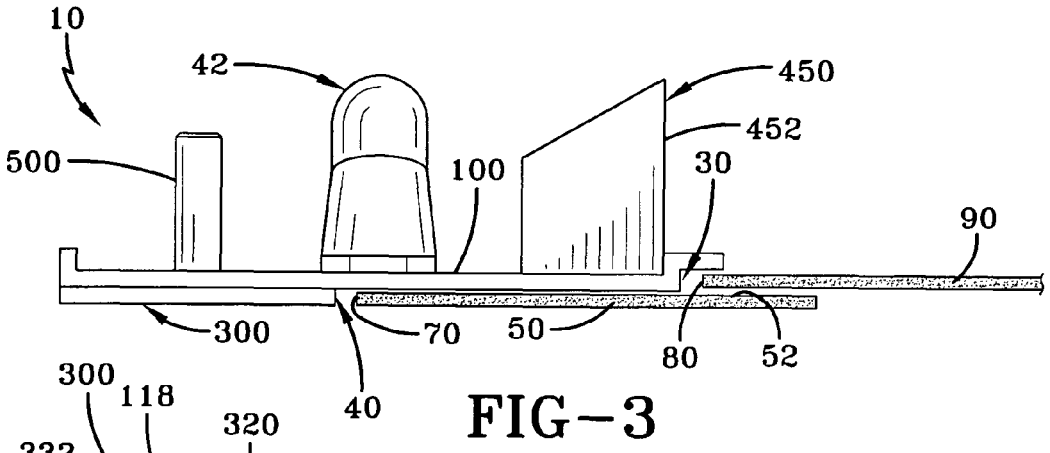
FIG. 3 is a side elevational view of the shingle installation device in accordance with the concepts of the present invention.

A shingle installation device in accordance with the concepts of the present invention is generally referred to by the numeral 10, as shown in FIG. 1 of the drawings. Before presenting the details of the shingle installation device 10, it should be appreciated that the term "shingle" may include 3 tab-type shingles, as well as any other covering applied in sections to a surface, such as the surface of a structure or frame, to shield the interior thereof from environmental elements. Continuing, the shingle installation device 10 comprises a body 20 that maintains a positioning stop 30 and an alignment stop 40 that are in substantial parallel arrangement with each other, and which are separated by a predetermined distance A, shown clearly in FIG. 2. It should be appreciated that the distance A is selected so as to provide a desired amount of overlap between shingles installed in succession. The installation device 10 also includes a handle 42 that allows a user to readily move or reposition the device 10 as needed during the shingle installation process. During use of the shingle installation device 10, an initial shingle or row of shingles 50 is installed using a chalk line or other suitable alignment means. Once the initial row of shingles has been installed, the installation device 10 is positioned upon one of the installed shingles 50, as shown in FIG. 3, such that the alignment stop 40 is positioned against a bottom edge 70 of the shingle 50. The positioning of the alignment stop 40 against the bottom edge 70 of the shingle 50 results in the positioning stop 30 being oriented at a predetermined point that traverses or extends across the top surface 52 of the installed shingle 50. Once in position, a bottom edge 80 of a new shingle 90 to be installed is placed against the positioning stop 30, such that the shingle 90 is properly oriented, and provides the desired amount of overlap with regard to the installed shingle 50 and is fastened in position. This process is then repeated by moving the installation device 10 via the handle 42 until the surface has been covered with the desired amount of shingles. As such, the installation device 10 significantly expedites the process of laying or installing shingles to cover a desired surface.

With the general operation of the shingle installation device 10 set forth, the following discussion will present the structural components of the device 10 in detail. Specifically, the frame or body 20 of the shingle installation device 10 maintains a top surface 100 opposite a bottom surface 110 that is bounded by opposed front and rear edges 112 and 114 and opposed lateral edges 116 and 118, as shown in the Figs. and more clearly in FIGS. 1, 4-5. In one aspect, the body 20 may comprise a flat, rigid, rectangular uni-body that is 91.44-99.06 cm in length, 21.59-23.18 cm in width, and 3.2-4.8 mm thick. However, it should be appreciated that the body 20 is not limited to such dimensions, and may be sized to take on any dimension or shape suitable for installing shingles of any size. In addition, the body 20 may be formed from plastic, such as injection-molded plastic containing ceramic material to enhance rigidity and durability of the device 10. However, the body 20 may be formed from any suitable material, including but not limited to steel, aluminum, fiberglass, and plastic. In addition, the body 20 may be coated or otherwise treated with any suitable surface covering, so that it takes on any desired color and/or texture, and to enable the device 10 to resist heating or damage from the sun.

It should also be appreciated that while the body 20 may be dimensioned to be approximately the length of a shingle, its dimensions may be shortened up to half its size to accomplish its purpose. Moreover, the body 20 may be shaped so that one or more of the edges 112,114,116,118 are rounded, tapered, or otherwise dimensioned to have any suitable shape. Additionally, the body 20 may be constructed with or without various other apertures disposed therethrough to lessen or redistribute its weight for balancing purposes, or the body 20 may be constructed of a more open-type rigid wire mesh material that allows for other fixtures to be fastened to it, or it may be constructed of more than one piece securely fastened together, etc. Furthermore, the top and bottom surfaces 100, 110 may have raised or curved portions or may be textured.

The body 20 maintains the positioning stop 30 that extends at a substantially right angle from the front edge 112 of the body 20 and away from the top surface 100. Extending away from the positioning stop 30 at a substantially right angle is a retainer 120. In particular, the retainer 120 extends away from the front edge 112, and is spaced from the bottom surface 110 of the body 20 by a suitable distance so as to form a gap 130 that is sized to receive the edge 80 of the shingle 90. Thus, when the installation device 10 is placed upon an installed shingle 50, the shingle 90 to be installed is received within the gap 130 so that the bottom edge 80 of the shingle 90 rests against and is aligned with the positioning stop 30. As such, the positioning stop 30 forms the edge surface that the newly placed shingles 90 will slide along and rest against as they are positioned for attachment to the surface being covered.

In one aspect, the retainer 120 may be constructed with injection-molded plastic, with ceramic added, so as to be integral with the body 20. Alternatively, the retainer 120 may be constructed separately and affixed to the body 20 by screws, rivets, or any other suitable fasteners. However, it should be appreciated that the retainer 120 may be formed from any suitable material, including but not limited to steel, aluminum, fiberglass, or plastic. Furthermore, the retainer 120 may extend 19.1 mm high from the bottom surface 110 of the body 10, and be 12.7 mm thick, although the retainer 120 may take on any other suitable dimension. Thus, the retainer 120 is configured to be spaced from the bottom surface 110 at a distance to enable the receipt of the shingles into the gap 130 as they are slid into place so that they do not encroach or otherwise slide over the top edge of the positioning stop 30 and become misaligned or out of position. Moreover, the retainer 120 provides a significant benefit in that shingles 90 are not permitted to slide or be easily moved after they are placed within the gap 130. Furthermore, the retainer 120 reduces movement of the shingle 90 once it is placed within the gap 130, thus preventing the shingle 90 from being moved out of position due to inadvertent movements by the installer. Additionally, the retainer 120 along with the gap 130 allows the installer to quickly insert the shingle 90 being installed into position by simply placing the edge 80 into the gap 130. As such, the installer is not burdened with having to precisely place the bottom edge 80 of the shingle 90 against the positioning stop 30.

In addition, the retainer 120 may be configured to provide an amount of compressive force to the shingle 90 being installed, to further prevent the shingle 90 being installed from being moved from its intended position. The retainer 120 may extend the entire length of the body 20 or a smaller portion or may extend over only a portion thereof.

In one aspect, the retainer 120 may not be utilized depending on the thickness of the body 20. As such, the thickness of the body 20 defined by the top and bottom surfaces 100,110 is dimensioned so that the bottom edge 80 of the shingle 90 being installed is able to be rested against the front edge 112.

It should also be appreciated that the retainer 120 may include one or more viewing ports 135 disposed therethrough that enable an installer to view the bottom edge 80 of the shingle 90 being installed, as it is inserted against the positioning stop 30. This is beneficial as the installer can visually confirm that the shingle 90 being installed is in proper alignment prior to being fastened into place.

Extending at a substantially right angle from the top surface 100 of the rear edge 114 of the body 20 is an edge guard 150. In one aspect, the edge guard 150 comprises a raised rib of material that is 3.2 mm thick, 19.1 mm high, and which extends from the top surface 100 of the body 20 and extending the entire length of the rear edge 114 of the body 20. However, the edge guard 150 may take on any other suitable dimension. In particular, the edge guard 150 is configured to stiffen, or otherwise strengthen the body 20 so as to keep it from warping, cracking or otherwise breaking during use. Furthermore, the edge guard 150 maintains a top edge 152 that is rounded, tapered, or dimensioned to any suitable shape. It should also be appreciated that the edge guard 150 may be extruded with injection-molded plastic with ceramic added so as to be integral with the body 20 or formed from any suitable material including, but not limited to, aluminum, steel, fiberglass, or plastic. It is also contemplated that the edge stop 150 is formed so as to be integral with the body 20 or may be separately attached using any suitable fastener, including but not limited to screws, rivets, or adhesive. In addition, the edge guard 150 may be coated or otherwise treated with any suitable surface covering, so that it takes on any desired color and/or texture, and to enable it to resist heating and damage from the sun. While the body 20 may only maintain one edge guard 150 located at its rear edge 114, multiple spaced edge guards 150 may be provided as needed for imparting additional strength to the body 20. In addition, the edge guard 150 may not extend all the way to the lateral edges 116,118 of the body 20.

Figure 5:
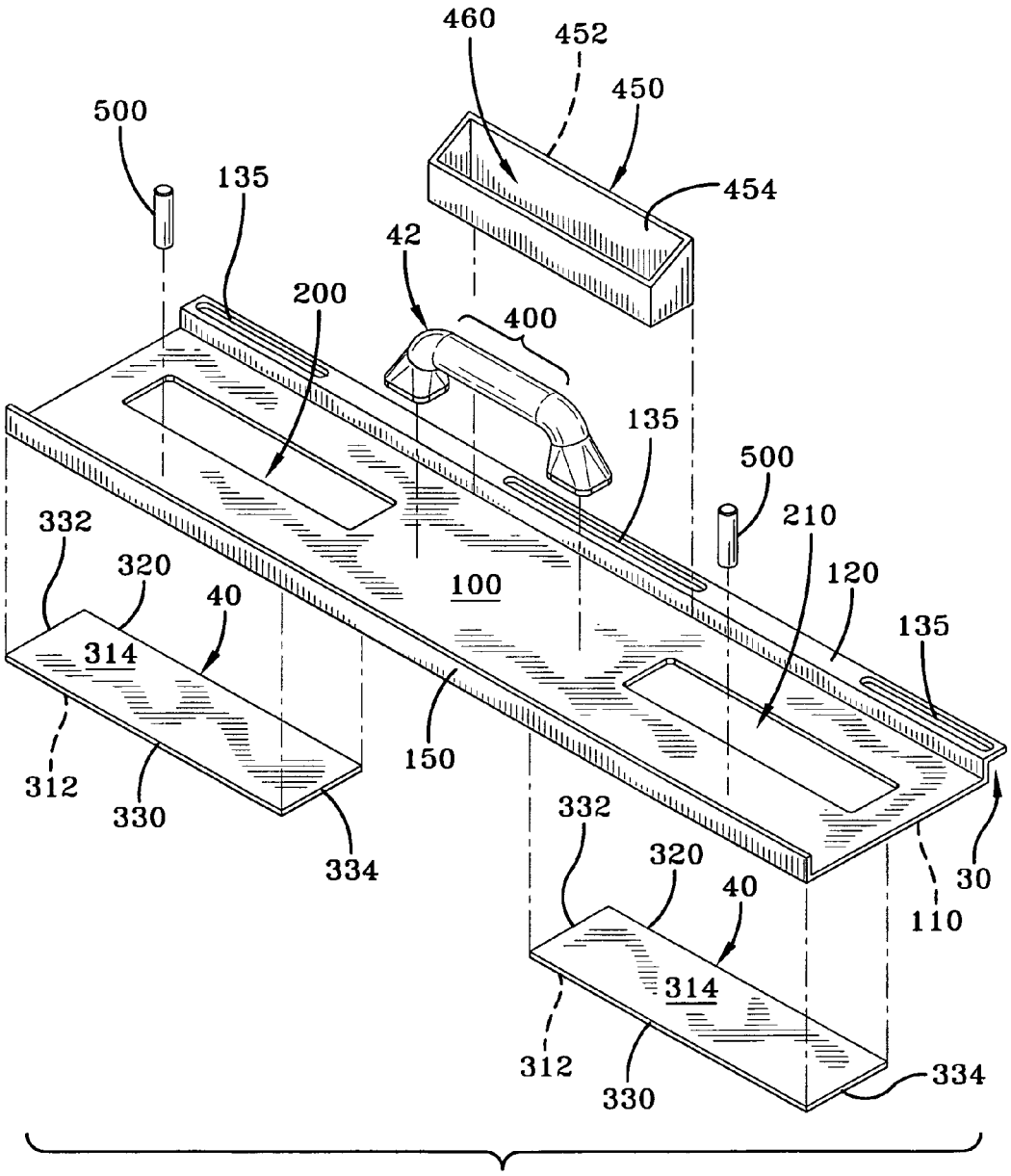
FIG. 5 is an exploded view of the shingle installation device in accordance with the concepts of the present invention.

Disposed through the top and bottom surfaces 100,110 of the body 20 are a pair of spaced viewing ports 200 and 210, as shown in FIGS. 1 and 5, that are configured to enable the user to view the installed shingle 50 when the installation device 10 is disposed thereon. In particular, the viewing ports 200 and 210 maintain opposed lateral edges 220,230 and opposed front and rear edges 240,250. Although two viewing ports 200,210 are shown in the Figs., it should be appreciated that any number of viewing ports may be maintained by the installation device 10. As such, the viewing ports 200,210 allow the installer to see whether or not the installation device 10 is fully seated against the previously laid shingle 50. The viewing ports 200,210 also provide a decrease in the weight of the device 10, making it easier to lift and move. It should be appreciated that while the viewing ports 200,210 are shown as being substantially rectangular in shape, they may take on any suitable shape, including circular or square, for example.

In one aspect, the viewing ports 200 and 210 are positioned so as to be spaced 5.08 cm in from respective body edges 116,118 and are dimensioned so as to be 27.94 cm long and 7.62 cm wide. Furthermore, the viewing ports 200,210 may be positioned so as to be substantially aligned with the front edge of associated spacers, which will be discussed below.

Figure 4:
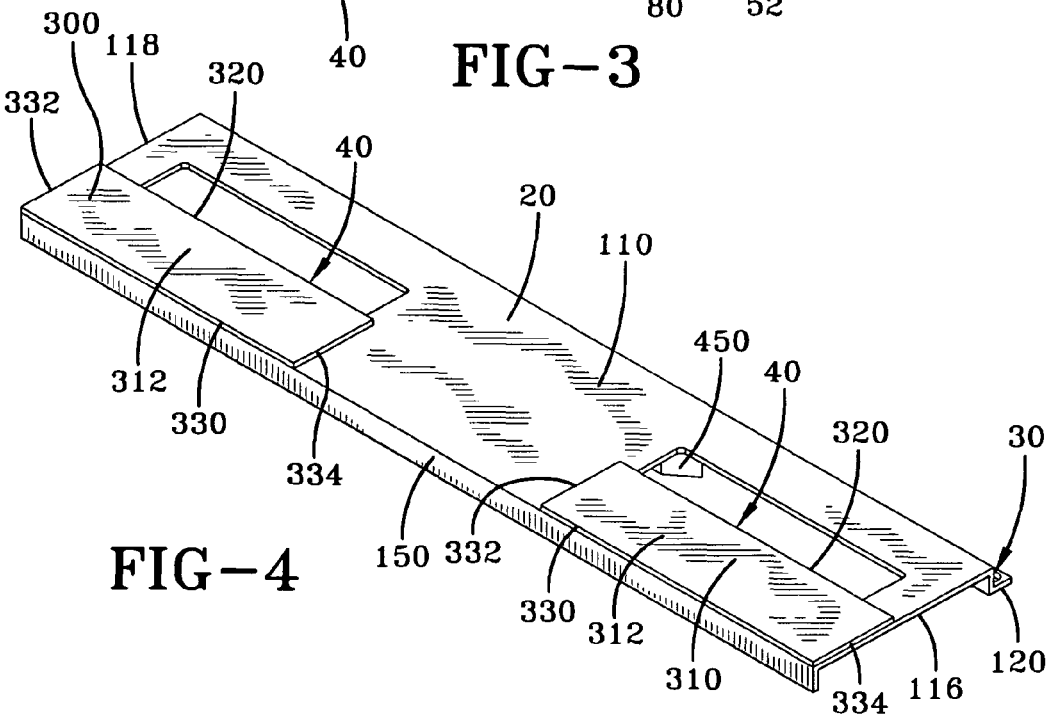
FIG. 4 is a bottom perspective view of the shingle installation device in accordance with the concepts of the present invention.
Figure 6:
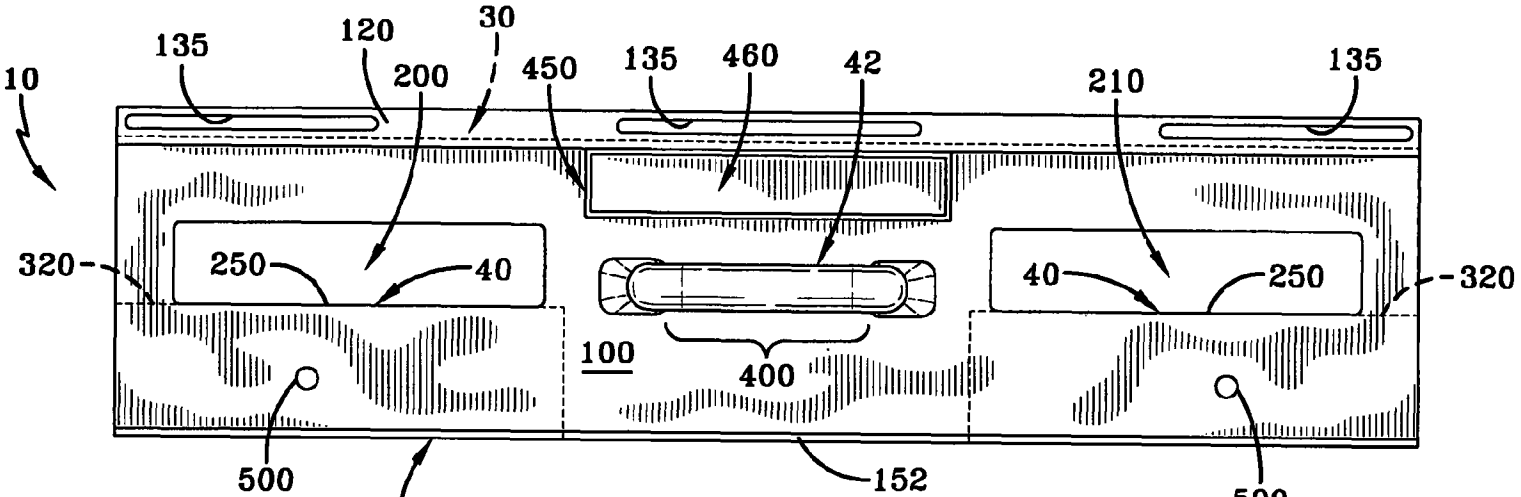
FIG. 6 is a top plan view of the shingle installation device in accordance with the concepts of the present invention.

The device 10 also includes a pair of spacers 300 and 310 having an application surface 312 for placement upon installed shingles 50 that is opposite an attachment surface 314 that is used for attachment to the bottom surface 110 of the body 20. It should also be appreciated that the spacers 300,310 may be attached to the body 20 using any suitable means of fixation, including, but not limited to, screws, rivets, or adhesive, although the spacers 300,310 may be made integral with the body 20. As shown in FIG. 4, the spacers 300, 310 maintain a front edge 320 that is substantially parallel with a rear edge 330 and substantially parallel lateral edges 332 and 334. In particular, the front edge 320 is substantially aligned with the rear edge 250 of the viewing ports 200,210, as shown in FIG. 6, so as to form the alignment stop 40. In other words, the front edge 320 maintained by the spacers 300,310 are aligned with one another, and thus form the alignment stop 40 that is substantially parallel with the positioning stop 30. Moreover, it should be appreciated that the distance indicated by the identifier A between the positioning stop 30 and the alignment stop 40 determines the relative amount of overlap between the previously installed shingle 50 and the shingle 90 being installed. In addition, it should also be appreciated that the rear edge 330 may be substantially aligned with the edge guard 150 but is not required. As such, the spacers 300,310 are dimensioned so that they extend or do not extend beyond the edges 112,114,116,118 of the body 20.

Furthermore, the spacers 300,310 are positioned with regard to the body 20 so that they do not occlude the opening defined by the viewing ports 200,210. Furthermore, the spacers 300,310 are dimensioned so as to have a height or thickness indicated by the identifier B, as shown in FIG. 2, that is substantially equal to the thickness of the shingles 50,90 that are being installed. While the spacers 300,310 are shown as being substantially rectangular in shape it should be appreciated that the spacers 300,310 may take on any suitable shape or thickness that substantially matches that of the shingles 50,90 being installed with the device 10. Moreover, the application surface 312 may be textured or otherwise treated to reduce or prevent slippage of the device 10 when the application surface 312 is placed upon a previously installed shingle 50.

In one aspect, the spacers 300,310 may be sized to be 30.48 cm long, 8.89 cm wide, and 9.5 mm thick when the device 10 has a length dimension of 91.44 cm so as to accommodate conventional 3-tab shingles. Or alternatively, the spacers 300, 310 may be sized to be 35.56 cm long, 8.89 cm wide, and 9.5 mm thick when the device 10 has a length dimension of 99.06 cm so as to accommodate dimensional-type shingles. Furthermore, the spacers 300,310 may be extruded with injection-molded plastic, with ceramic added, so as to be made integral with the body 20. Moreover, the spacers 300,310 may be covered or otherwise treated to resist heat or damage from the sun. In another aspect, the front edge 320 of the spacers 300,310 may be spaced 12.7 cm from the positioning stop 30 when the length of the device 10 is 91.44 cm. Alternatively, the front edge 320 of the spacers 300,310 may be spaced 14.29 cm from the positioning stop 30 when the length of the device 10 is 99.06 cm.

Furthermore, the spacers 300,310 may also be formed of any suitable material, including, but not limited to, steel, aluminum, plastic, or fiberglass. In addition, the spacers 300, 312 may be constructed of flat stock material, corrugated material, tapered material, as well as any combination thereof. Moreover, the spacers 300,312 may be constructed as simple ribs of material that maintain edges 320 that are parallel to the positioning stop 30, rather than a flat stock. In addition, the spacers 300,310 may be moved so that the alignment stop 40 is placed at varying distances from the positioning stop 30 to accommodate and provide the desired amount of overlap between the various types and sizes of shingles being used. It should also be appreciated that the body 20 may maintain one or more spacers 300,310 to form the positioning stop 40.

Figure 7:
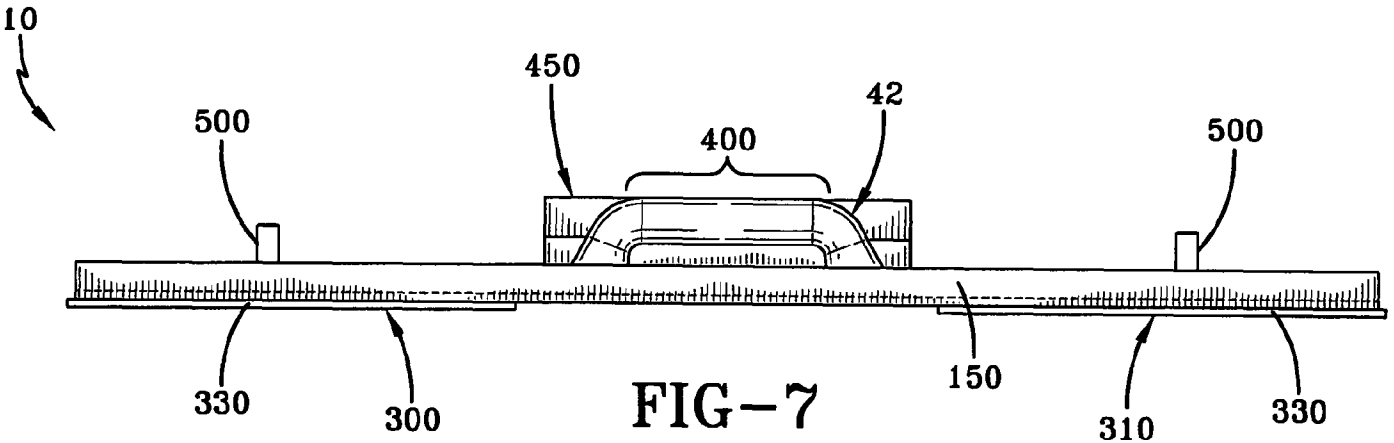
FIG. 7 is bottom elevational view of the shingle installation device in accordance with the concepts of the present invention.

Extending from the upper surface 100 of the installation device 10 is the handle 42. Specifically, the handle 42 is located in a balanced position with respect to the body 20, such as in the center of the body 20, as shown clearly in FIG. 7. In one aspect, the handle 42 may be located 10.16 cm from the rear edge 114 of the body 20 and laterally centered between the edges 116,118. The handle 42 may be formed from injection-molded plastic so as to be made integral with the body 20. However, the handle 42 may be formed from any other suitable material, including, but not limited to, steel, aluminum, plastic, and fiberglass may be used. The handle 42 may be configured to be proportioned so as to fit a wide range of grip sizes, such that a grab surface 400 maintained by the handle 42 is approx. 20.32 cm long by 2.54 cm wide. In one aspect, the grab surface 400 may extend 2.54 cm from the top surface 100, although any other suitable dimension may be used. In one aspect, the handle 42 may be integrally formed with that of the body 20 or may be separately constructed and fastened into place using any suitable fastener. Furthermore, the handle 42 may also be coated or otherwise treated with any suitable surface covering, so that it takes on any desired color and/or texture, and to enable the device 10 to resist heating and damage from the sun. The surface of the handle 42 may be textured to enhance the ability of a user to grip the device 10. In another aspect, the handle 42 and/or grab surface 400 may be positioned lengthwise with the body 20, as shown in the Figs, or aligned widthwise with the body 20. By positioning the handle 42 and/or grab surface 400 lengthwise on the body 20 so that the grab surface 400 is substantially parallel with the positioning stop 30 facilitates the ease with which the user can move the device 10 into the needed position to install successive shingles.

In one aspect the handle 42 may be constructed of any suitable material, including, but not limited to, steel, aluminum, plastic, or fiberglass. In addition, the grab surface 400 may be rubberized and/or maintain notched finger grips as well.

Figure 8:
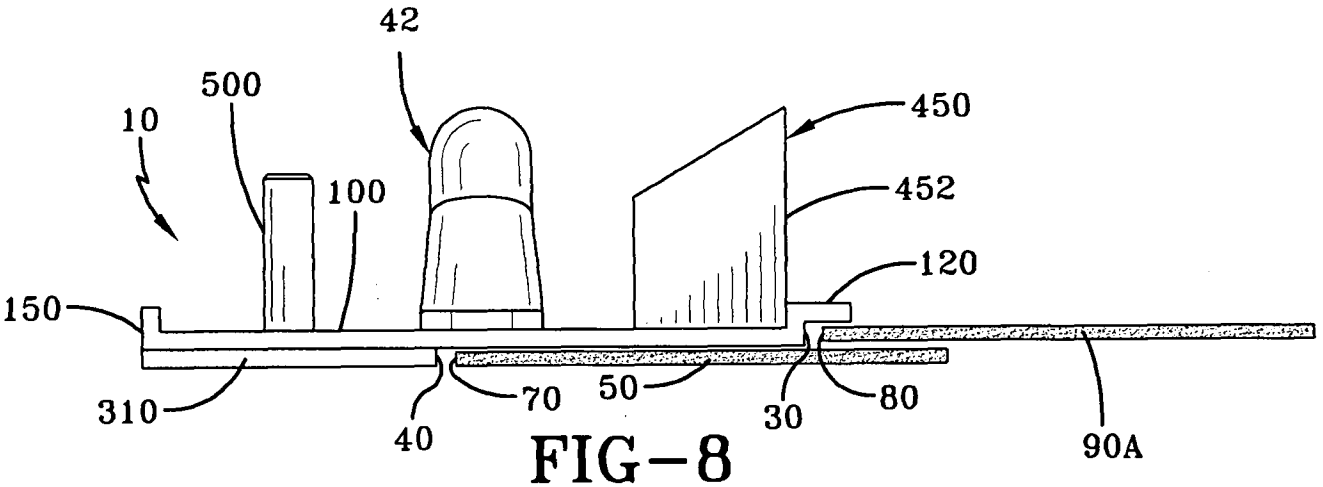
FIG. 8 is a side elevational view of the shingle installation device as used during the shingle installation process.
Figure 9:
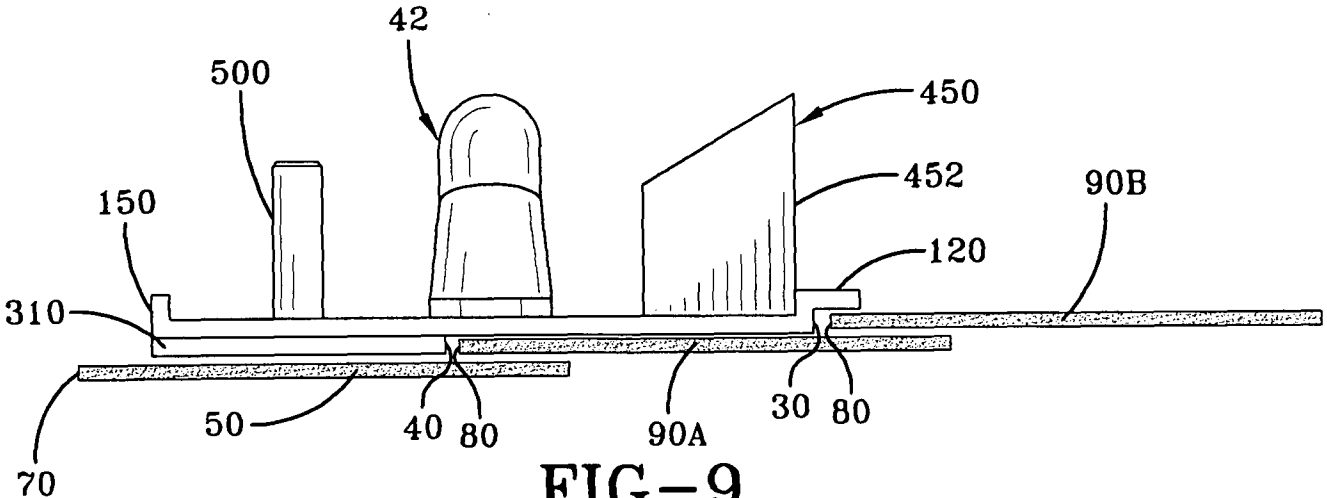
FIG. 9 is another side elevational view of the shingle installation device as used during the shingle installation process.

It is also contemplated that the installation device 10 includes a shield 450, as shown in FIGS. 8 and 9, that extends at a substantially right angle from the top surface 100 of the body 20. Specifically, the shield 450 is positioned so that it is located between the handle 42 and the positioning stop 30. However, the shield 450 may be located in any desired position. In one aspect, the shield 450 may be located adjacent the positioning stop 30. In addition, the shield 450 maintains a guard surface 452 that is opposite a back surface 454. The shield 450 may also include a container 460 that is integral with the back surface 454, and which is suitable for carrying or maintaining various tools, such as a knife, hammer, or other tool. Alternatively, it should also be appreciated that the device 10 may separately maintain either of the container 460 or the shield 450. As such, the shield 450 serves to protect the hand of an installer from the edges 80 of the shingle 90 being installed as he or she places the shingle 90 adjacent the positioning stop 30.

The shield 450 may be constructed separately and welded into place or securely fastened to the body 20 using screws, rivets, or any other suitable fastener. The shield 450 may also be constructed of various metals, including, but not limited to, steel, aluminum, plastic, or fiberglass. In addition, the container 460 may be configured to take on any suitable shape, including, but not limited to, an oval or a square.

In one aspect, the shield 450 is dimensioned so as to be 3.2 mm thick, 25.4 cm long, 5.08 cm wide, and 5.08 cm high. In another aspect, the shield 450 is centered end to end on the body 20 directly behind, adjacent to, and parallel with, the positioning stop 30. The shield 450 and container 460 maintained thereby enables quick access to a utility knife or other small tools that might be needed during shingle installation. In one aspect, the shield 450 may be formed from any suitable material, including being extruded with injection-molded plastic, with ceramic added. Furthermore, the shield 450 may be coated or otherwise treated with any suitable surface covering, so that it takes on any desired color and/or texture, and to enable the device 10 to resist heating and damage from the sun. It should also be appreciated that the shield 450 may be made integral with the body 20 or separately attached thereto using any suitable means of fixation, including screws, adhesive, rivets, or other suitable fastener.

The device 10 also includes one or more coil rests or retaining rods 500 that extend at a substantially right angle from the top surface 100 of the body 20. The retaining rods 500 may have any suitable cross-sectional shape, and are dimensioned to retain one or more coils of nails (not shown) used by a nail gun typically used to fasten shingles to the surface being covered thereby. Moreover, the retaining rods 500 may be attached to the body 20 using any suitable means of fixation, including, but not limited to, screws, rivets, or adhesive. The retaining rods 500 may be formed from any suitable material, including being extruded with injection-molded plastic, with ceramic added, so as to be made integral with the body 20. The retaining rods may also be constructed of any suitable materials, including, but not limited to, steel, aluminum, plastic, and fiberglass. In addition, the retaining rods 500 may be replaced with a container for retaining the nail coils.

In one aspect, the retaining rods 500 may be formed as cylindrical pegs, that are 19.1 mm in diameter and extend 7.62 cm from the top surface 100 of the body 20, such that one or more coils of roofing nails may rest thereover, or be otherwise retained thereby, so as to allow the nail coils to be carried by the installation device 10 for quick access during the shingle installation process. In addition, the retaining rods 500 may be located in a balanced position on either side of the handle 42, such that they are 20.32 cm from either lateral edge 116,118 and 5.08 cm in from the rear edge 114 of the body 20. Furthermore, the retaining rods 500 may be covered or otherwise treated so as to resist heat or damage from the sun.

As such, the shingle installation device 10 enables a single user or installer to install shingles to cover any portion of a desired surface, including but not limited to a roof or wall surface, in an expedited or efficient manner. In addition, the installation device 10 also decreases the amount of fatigue experienced by the installer, thus allowing him or her or work longer with increased productivity.

With the structural aspects of the shingle installation device 10 set forth, the process for using the device 10 to install shingles is initiated by first installing an initial shingle or row of shingles 50 using a chalk line or any other suitable tool to ensure that the initially installed shingle or shingle 50 are properly aligned with a desired reference point. However, it should be appreciated that while a shingle or initial row of shingles 50 installed using an alignment tool, such as a chalk line, ensures that subsequent shingles to be installed 90 are aligned with one another, such is not required to use the shingle installation device 10. However, the following example contemplates that at least one initially aligned shingle 50 has been laid. Once the initial shingle 50 is laid, the user moves the installation tool 10 into position such that the alignment stop 40 formed by the front edge 320 of the spacers 300,310 is placed against the bottom edge 70 of the installed shingle 50, as shown in FIG. 8. Once in position, the user confirms that the installation tool 10 is in proper position by looking through the viewing ports 200,210. Next, the shingle to be installed 90A is inserted within the gap 130 where it is held in position by the retainer 120, such that the bottom edge 80 of the shingle 90A rests against the positioning stop 30. At this point, the shingle 90A is in position for installation via any suitable fastener, such as a nail inserted via a nail gun, for example. Next, as shown in FIG. 9, the user moves the installation device 10 so that the alignment stop 40 is placed against the bottom edge 80 of the shingle 90A. Next, the shingle to be installed 90B is placed within the gap 130 so that the bottom edge 80 of the shingle 90B rests against the positioning stop 30, and retained therein by the spacer 210, whereupon the shingle 90B is in proper position, and alignment with shingle 90A so as to be fastened in place. Thus, to continue the installation of shingles 90, the device 10 is positioned upon the previously-installed shingle 90, and the installation process continues until the desired amount of shingle coverage is obtained.

It should be appreciated that the process set forth above may be facilitated if edge or center starter shingles are cut creating a pyramid effect for installation. The shingle manufacturer generally describes this method on the shingle packaging material or in an installation guide. Moreover, during the installation process, the shield 450 protects the installer's hand should the shingle 90 slip over the positioning stop 30 and fall towards him or her as it is being placed in the gap 130. When it is time to reload the roofing nailer, the installer may access the retaining rods 500 for additional nail coils.

While the shingle installation device 10 enables a single person to install shingles, other individuals may be utilized to assist in the placement of the shingles so as to further expedite the efficiency in which the shingle installation process is carried out.

It will therefore be appreciated that one advantage of one or more embodiments of the present invention is that a shingle installation device provides a retainer to hold shingles to be installed in position as they are fastened in place. Still another advantage of the present invention is that a shingle installation device provides a handle having a grab surface that is substantially aligned with the length orientation of the body maintained by the shingle installation tool to facilitate the movement of the installation device. Another advantage of the present invention is that a shingle installation device provides a shield to prevent shingles from striking the hand of a shingle installer during the shingle installation process.

Thus, it can be seen that the objects of the invention have been satisfied by the structure and presented above. While in accordance with the Patent Statutes, only the best mode and preferred embodiment has been presented and described in detail, it is to be understood that the invention is not limited thereto or thereby. Accordingly, for an appreciation of the true scope and breadth of the invention, reference should be made to the following claims.

What is claimed is:

1. A shingle installation device to attach shingles to a surface comprising:

a body having a first surface opposite a second surface;

a positioning stop having a longitudinal extent along said body to align an edge of a shingle to be installed;

an alignment stop extending from said second surface configured to be positioned against an installed shingle, said positioning stop and said alignment stop being parallely spaced at a predetermined distance from each other, wherein said alignment stop includes an edge provided by at least one alignment spacer attached to said second surface of said body;

a retainer extending from said positioning stop, said retainer spaced from said second surface of said body to form a gap to retain the edge of the shingle to be installed; and at least one first elongated viewing port extending along a longitudinal axis, said longitudinal axis of said viewing port in parallel alignment with said longitudinal extent of said positioning stop and disposed through said retainer to view the bottom edge of the shingle retained within said gap as it is placed against said positioning stop;

wherein said body includes at least one second viewing port disposed therethrough, said at least one second viewing port having an edge in alignment with said edge of said alignment stop.

2. The shingle installation device of claim 1, further comprising a handle attached to said first surface, said handle extending along a longitudinal axis, said longitudinal axis of said handle being substantially parallel with said longitudinal extent of said positioning stop.

3. The shingle installation device of claim 2, further comprising a shield attached to said first surface of said body, said shield positioned between said handle and said positioning stop.

4. The shingle installation device of claim 2, further comprising at least one retaining rod attached to said first surface, and adapted to carry at least one nail coil.

5. A method for installing a shingle to a surface, the method comprising:

providing a shingle installation device comprising a body having a length orientation and a width orientation, said body having a parallely oriented positioning stop and alignment stop separated by a predetermined distance, said positioning stop maintaining a retainer extending therefrom to form a gap, said alignment stop having an edge provided by at least one alignment spacer attached to a surface of said body, said retainer including at least one first elongated viewing port disposed therethrough to view a shingle to be installed that is received within said gap, and said body including at least one second viewing port disposed therethrough, said at least one second viewing port having an edge in alignment with said edge of said alignment stop;

providing a predetermined reference edge upon the structure;

aligning said alignment stop against said reference edge;

viewing said reference edge through said at least one second viewing port;

placing one edge of a shingle to be installed against said positioning stop and within said gap such that said shingle to be installed is offset from said reference edge by said predetermined distance;

viewing the one edge of the shingle against said positioning stop through said at least one first elongated viewing port; and attaching said shingle to be installed to the surface with at least one suitable fastener.

6. The method of claim 5, wherein said body maintains a first surface opposite a second surface, wherein said positioning stop is maintained along an edge of said body, and said alignment stop extends from said second surface.

7. The method of claim 6, wherein said body includes a handle attached to said first surface of said body, said handle maintaining a grab surface aligned with said length orientation of said body.

8. The method of claim 7, wherein said body includes a shield attached to said first surface of said body, said shield positioned between said handle and said positioning stop.

9. The method of claim 7, wherein said body includes at least one retaining rod attached to said first surface, and adapted to carry at least one nail coil.

10. A shingle installation device to attach shingles to a surface comprising:

a body having a first surface opposite a second surface, and opposed first and second lateral edges;

a positioning stop having an a longitudinal extent along said body to align an edge of a shingle to be installed;

an alignment stop extending from said second surface configured to be positioned against an installed shingle, said positioning stop and said alignment stop being parallely spaced at a predetermined distance from each other, wherein said alignment stop includes an edge provided by at least one alignment spacer attached to said second surface of said body;

a retainer extending from said positioning stop, said retainer spaced from said second surface of said body to form a gap to retain the edge of the shingle to be installed;

at least one first elongated viewing port disposed through said retainer to view the edge of the shingle retained within said gap as it is placed against said positioning stop, said at least one first elongated viewing port extending along a longitudinal axis, said longitudinal axis of said at least one first elongated viewing port in parallel alignment with said longitudinal extent of said positioning stop; and a handle attached to said first surface and spaced from said first and second lateral edges a substantially equal distance, said handle extending along a longitudinal axis, said longitudinal axis of said handle being substantially parallel with said longitudinal extent of said positioning stop;

wherein said body includes at least one second viewing port disposed therethrough, said at least one second viewing port having an edge in alignment with said edge of said alignment stop.

11. The shingle installation device of claim 10, wherein said body has a rear edge substantially parallel to said longitudinal extent of said positioning stop, said handle spaced a substantially equal distance from said rear edge and said longitudinal extent of said positioning stop.

* * * * *